US008397443B2

(12) United States Patent
Blom et al.

(10) Patent No.: US 8,397,443 B2
(45) Date of Patent: Mar. 19, 2013

(54) BAR SYSTEM

(75) Inventors: Fredrik Blom, Vargarda (SE); Kent Blom, Vargarda (SE)

(73) Assignee: Bygg-Och Miljoteknik Granab AB (SE)

( * ) Notice: Subject to any disclaimer, the term of this patent is extended or adjusted under 35 U.S.C. 154(b) by 0 days.

(21) Appl. No.: 13/512,925

(22) PCT Filed: Dec. 2, 2009

(86) PCT No.: PCT/EP2009/066196

§ 371 (c)(1),
(2), (4) Date: May 31, 2012

(87) PCT Pub. No.: WO2011/066854

PCT Pub. Date: Jun. 9, 2011

(65) Prior Publication Data

US 2012/0240484 A1 Sep. 27, 2012

(51) Int. Cl.
*E04G 1/22* (2006.01)

(52) U.S. Cl. ..... 52/126.7; 52/125.6; 52/126.1; 52/126.2; 52/126.5

(58) Field of Classification Search ..... 52/126.7, 52/122.1, 125.6, 126.1, 126.2, 126.5
See application file for complete search history.

(56) References Cited

FOREIGN PATENT DOCUMENTS

WO 9726424 A1 7/1997

OTHER PUBLICATIONS

International Search report for PCT/EP2009/066196, Completed by the European Patent Office on Oct. 26, 2010, 3 Pages.
Written Opinion for PCT/EP2009/066196, Completed by the European Patent Office on Oct. 26, 2010, 4 Pages.

*Primary Examiner* — Mark Wendell
(74) *Attorney, Agent, or Firm* — Brooks Kushman P.C.

(57) ABSTRACT

A bar system for building, the system provided with a plurality of bars, a level adjustment mechanism, and a dampener. Each of the bars having a recess positioned in a shank portion, with bars being adapted in use to at least partly enclose the level adjustment mechanism. The level adjustment mechanism including level adjustable projections adapted to project from the bars against a support structure, and provided with a surface which extends in a longitudinal direction of the bars, as seen in the use of the system, and with engagement adapted for engagement with recess. The shank, which the recesses that is adapted to engage with the engagement, is adapted to press the engagement towards level adjustment during application of the bars to the level adjustment, and recess is adapted to allow the engagement for moving resiliently back for engagement with recess in an interconnected position.

19 Claims, 8 Drawing Sheets

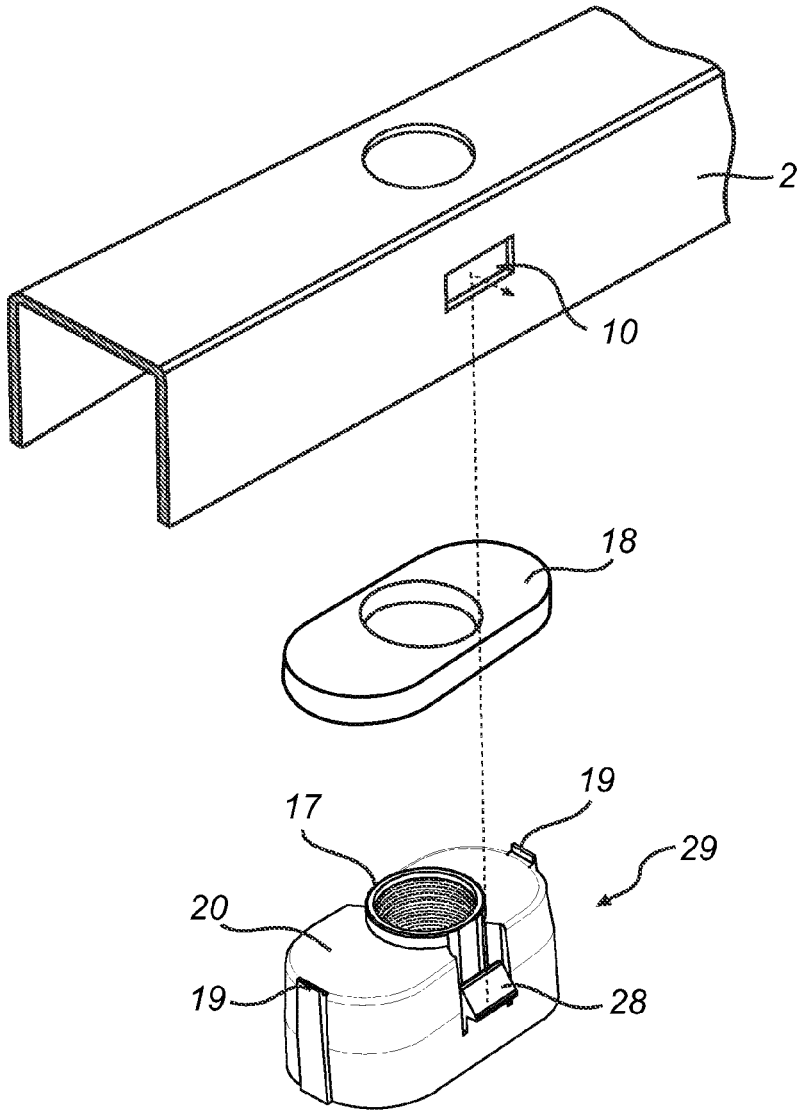
Fig. 7
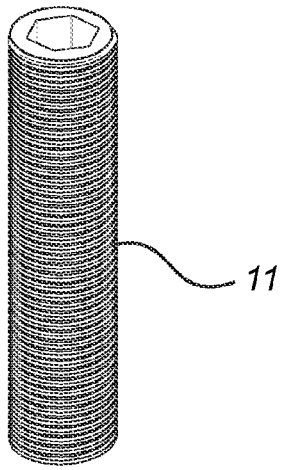

BAR SYSTEM

CROSS-REFERENCE TO RELATED APPLICATION

This application is the U.S. national phase of PCT Appln. No. PCT/EP2009/066196 filed on Dec. 2, 2009, the disclosure of which is incorporated in its entirety by reference herein.

FIELD OF THE INVENTION

The present invention relates to a bar system for building constructions, comprising bars, level adjustment means, and dampening means. Each of the bars comprises a recess, positioned in a shank of each bar. The bars are adapted in use to at least partly enclose the level adjustment means. The level adjustment means comprises level adjustable projections, which are adapted to project from the bars against a support structure. The level adjustment means are provided with a surface which extends in a longitudinal direction of the bars, as seen in the use of the system, and with engagement means adapted for engagement with said recess.

BACKGROUND OF THE INVENTION

In many cases it is suitable to mount floors, interior walls or the like such that a spacing is formed between the mounted surface and the basis support structure. Bars are usually used in such cases, which are placed so as to rest against the support structure, whereupon the new surface material may be attached to the bars. Since the basis surface is not as a rule completely even, it is advantageous to provide the bars with support legs the height of which may be easily adjusted to raise the bars somewhat from the support structure and to orientate them in a simple manner according to wish.

Since the support structure of such basis surfaces, consisting often of concrete or the like, are often hard and completely rigid, it is desirable to be able to arrange dampening means for providing the new surface material resiliency for enabling a good working or living environment and for avoiding health problems such as pain in backs and legs.

The dampening means may also provide the new surface material acoustical dampening, which is of great importance for a good working and living environment. The acoustical dampening may refer to both insulation of airborne sound and impact sound. Today, the requirements for noise levels in offices and schools are more strictly defined. Also, when building new homes a good sound environment has become a prioritised requirement.

One example of a bar system having level-adjustment legs and dampening means is described in EP0874943, which discloses level adjustment means comprising a rod and a sleeve which are interconnected by a thread engagement system. Also, a rubber seal may be positioned on the sleeve facing the bar for providing resiliency and/or sound reduction.

SUMMARY OF INVENTION

An object of the present invention is to provide an improved bar system.

According to an aspect of the invention, the bar system for building constructions, comprises bars, level adjustment means, and dampening means, each of said bars comprising a recess positioned in a shank of said bars, said bars being adapted in use to at least partly enclose the level adjustment means, said level adjustment means comprising level adjustable projections, being adapted to project from the bars against a support structure, said level adjustment means being provided with a surface which extends in a longitudinal direction of the bars, as seen in the use of the system, and with engagement means adapted for engagement with said recess. The shank, which comprises the recesses that is adapted to engage with the engagement means, is adapted to press said engagement means towards said level adjustment means during application of the bars to the level adjustment means, and said recess is adapted to allow the engagement means for moving resiliently back for engagement with said recess in an interconnected position, and in that the dampening means extends in a longitudinal direction of the bars, as seen in the use of the system, and said surface of the level adjustment means is adapted to support the dampening means.

Such a design having engagement means which are pressed towards the level adjustment means during application of the bars to the level adjustment means have several advantages. Firstly, such a design makes it possible to produce engagement means which are stronger than engagement means which are pressed away from the level adjustment means, since due to manufacturing reasons such a design makes it possible to have a larger joint between each engagement means and the level adjustment means. In addition, such a design is more robust also since the engagement means are pressed in abutment against the level adjustment means before a force large enough for breaking the engagement means is applied. Thus, the design hinders from breaking engagement means while assembling the bar system. A level adjustment means having a broken engagement means is unusable and has to be replaced with an unbroken one, which increases the costs. Consequently, the design also results in a more cost-efficient system.

Such a system is often transported to the user in a pre-assembled state. That is, the bars are during transportation assembled with the level adjustment means. Since the bars at least partly encloses the level adjustment means in an assembled position, the bars protects the engagement means against breaking during transport of the bar system. Since fewer engagement means will be broken, fewer level adjustment means has to be replaced, while mounting the system at the intended place. Hence, it is possible to save both time used to mounting the system and number of level adjustment means, which increases the cost-efficiency of the system. In addition, such a design results in that the system has a substantially smooth surface which simplifies loading of the system into a freight container when transporting it to the user. Also, more bars may be loaded in the same space since the total volume of the assembled system will be smaller.

Since the level adjustment means are engaged to the bars such that the bars at least partly enclose the level adjustment means, there is no need for the level adjustment means to have a larger extension than the bars in a vertical direction. This also results from the inventive idea that the engagement means are such that they press towards the shanks of the bars. They do not need to "surround" or enclose the shank. Thus, the level adjustment means may be smaller, resulting in smaller consumption of material, which in turn results in a still more cost-efficient bar system. Furthermore, this feature also ensures that the engagement means are not in any way interfering with the space on the sides of the bars. Such space may be needed for i.a. insulation material and any volume that is not filled with insulation material reduces the insulation capacity, either it is heat insulation or sound insulation.

The dampening means provide the mounted floor with both mechanical and acoustical dampening. Dampening means having a longitudinal extension yields a higher dampening effect than shorter dampening means. The design of the level adjustment means increases the cost-efficiency of the system further, since such a level adjustment means may be produced more efficiently than prior art.

According to an exemplary embodiment, said recesses are adapted to receive said engagement means. According to an exemplary embodiment, said recesses are through recesses. Through recesses are advantageous since they are easier to produce and enable easier dismantling of the bar system if desired.

According to an exemplary embodiment, said engagement means are adapted for snap fastening attachment to the corresponding recesses. Such a fastening attachment is a smooth and easy way to attach the level adjustment means to the bars, since it does not require that screws or other fastening means are fastened to the engagement means. In addition, such type of fastening attachment is rapid and may be locked and, if needed, may be detached completely manually without using tools or with the aid of simple tools only. In addition, such an attachment may be automated.

According to an exemplary embodiment, said engagement means are provided with locking projections formed on arms, which locking projections are protruding outwards from a side of the level adjustment means that is facing the shank in use of the system. Such locking projections are easy to use, since they are flexible at the same time as they provide the system with reliable locking. The locking projection may extend from an upper end of the level adjustment means or from a lower end of the level adjustment means.

According to an exemplary embodiment, said locking projections comprise bevelled edges facing the bars during application of the bars, for facilitating said application. Such bevelled edges facilitates the application of the bars to the level adjustment means, since a force applied by the bars to such a bevelled edge in a longitudinal direction of the locking projection comprises a component force which is normal to the surface of the bevelled edge and actions towards the level adjustment means. Thus, the bevelled edges result in that the engagement means are in an automatic manner pressed against the level adjustment means during application of the bars.

According to an exemplary embodiment, the level adjustment means are provided with a through hole, which through hole is internally threaded and which threads are matching external threads provided on the level adjustable projections. Such threads make it possible to easily adjust the height of the level adjustable projections, which may be advantageous for instance if the support structure is not completely even or if a certain inclination of the mounted surface is desired. In addition, the threads enable for disengaging the level adjustable projections from the level adjustment means for instance during transportation of the bar system. Alternatively, the level adjustable projections may be easily screw engaged to the level adjustment means not before mounting of the bar system at the intended place.

According to an exemplary embodiment, a side of the shanks opposite to the level adjustment means comprises projecting flanges extending in a longitudinal direction of the bars. Such flanges may carry for instance insulation material for thermal or sound purposes.

According to an exemplary embodiment, the level adjustable projection may be screwed into or out from the level adjustable means through holes in the bars, from the side of the bars opposite a side facing the support structure. Such a design makes it easy to adjust the level of each level adjustable projection when the bar system is mounted at the desired place such that the bar system is perfectly horizontal or has a by the user desired inclination.

According to an exemplary embodiment, dampening means are adapted to be positioned vertically between said bars and said level adjustment means as seen in the use of the system. Such a position of the dampening means enables dampening of the floor mounted on the bar system.

According to an exemplary embodiment, a side of the level adjustment means which in use is facing away from the support structure comprises an annular projection protruding from said side and having a circumference which matches a through hole of the dampening means. Such a strip is advantageous, since it prevents the dampening means from moving in a longitudinal direction of the level adjustment means during pre-assembling or use of the system.

According to an exemplary embodiment, an extension of the dampening means transversally to the bars, as seen in the use of the system, is larger than an extension of the level adjustment means in the same direction, as seen in the use of the system, and wherein an end of the surface of the level adjustment means comprises means for guiding and retaining the dampening means in a position that inhibits the bars from being in contact with the level adjustments means during use of said system. Such a design ensures that the dampening means are retained correctly positioned during use of the system for enabling good sound reduction. If the level adjustment means would be in contact with the bars the acoustical dampening will be short-circuited and not work properly. In addition, such guiding and retaining means may be useful for positioning and retaining the dampening means in a correct position during assembling of the bar system. It may be especially useful if the assembling is automated.

According to an exemplary embodiment, said means for guiding and retaining the dampening means comprise at least one protrusion, which protrudes substantially perpendicularly from the surface of the level adjustment means and is adapted to abut against a lateral side of the dampening means, which lateral side is in use of the system transversal to the bars. Such a protrusion facilitates positioning the dampening means aligned with the level adjustment means in a longitudinal direction of the bars. A protrusion which abuts against a lateral side of the dampening means inhibits the dampening means from rotating in its plane and therefore retains the dampening means aligned with the level adjustment means which simplifies the application of the bars.

Here, the wording "a lateral side of the dampening means" is intended to mean a part of a circumference of the dampening means, which is substantially non-parallel but need not to be perpendicular to the shanks of the bars.

According to an exemplary embodiment, said retaining means comprises two sets of protrusions, each of which comprises at least two separate protrusions, which protrusions and sets of protrusions are oppositely arranged in relation to each other, and which protrusions are arranged to abut on opposite parts of a lateral side of the dampening means. Such two protrusions may together have an extension along the circumference of the dampening means that is smaller than an extension of an oblong protrusion along the whole part of the circumference of the dampening means which is substantially perpendicular to the shanks of the bars. Thus, the consumption of material may be smaller resulting in a more cost-efficient bar system.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, where the same reference numerals will be used for similar elements, wherein:

FIG. 7 is a perspective view of part of a bar system according to an alternative embodiment of the invention.

DETAILED DESCRIPTION OF EXEMPLARY EMBODIMENTS

The embodiments of the invention are described and illustrated throughout this application as standing on a support structure such as a floor. Hence, words as "upper" and "lower" are intended to have their ordinary meaning in a vertical direction. Thus, an upper end is an end that is father away from the support structure than a lower end. However, the bar system may also be used on other types of support structures such as walls or ceilings. In such cases "upper" is to be interpreted as farther away from the support structure than "lower". Thus, "an upper side" is the side facing away from the support structure in use of the system and "a lower end" is the end which is nearest the support structure in use of the system. Words as "above" and "under" is intended to be interpreted in a similar way.

Figure 1:
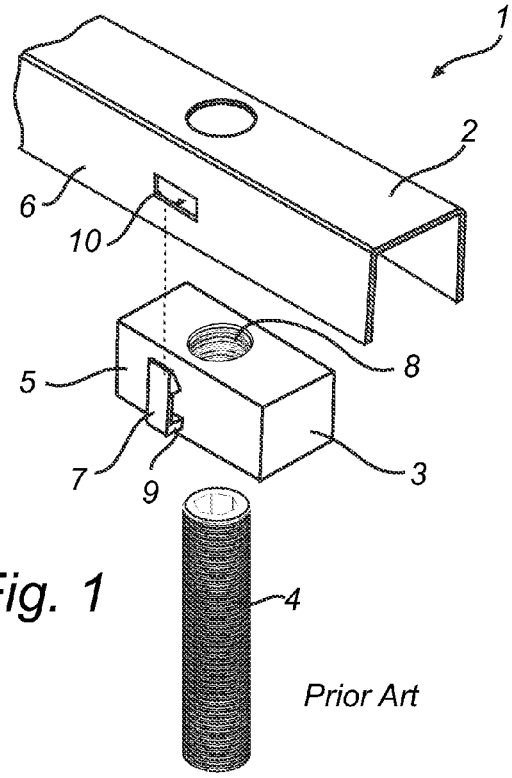
Fig. 1 Prior Art
FIG. 1 is an exploded view in perspective of a part of a bar system according to prior art.
Figure 2A:
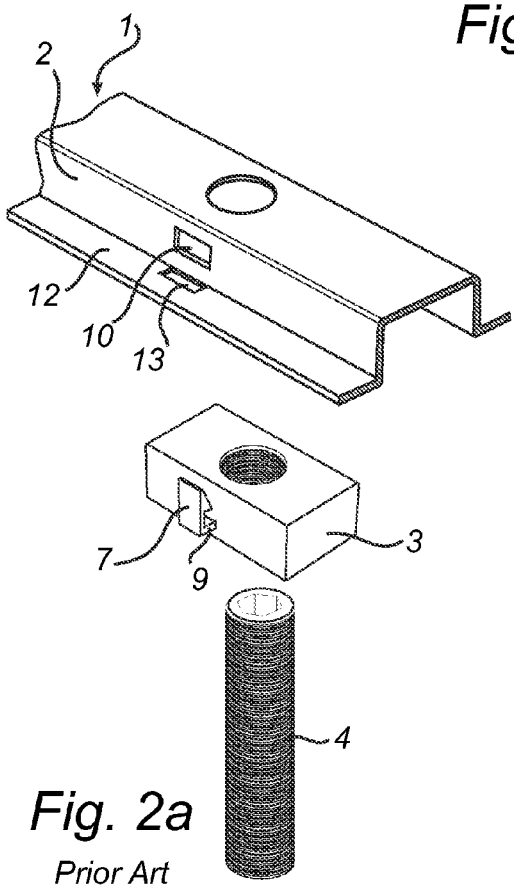
Fig. 2a Prior Art
FIG. 2*a* is an exploded view in perspective of an alternative embodiment of prior art.
Figure 2B:
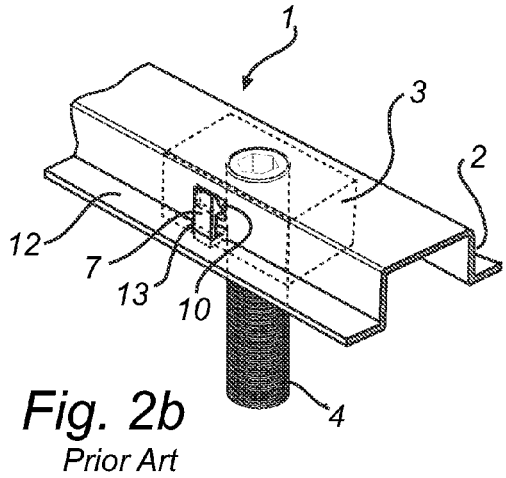
Fig. 2b Prior Art
FIG. 2*b* is a perspective view of the part of the bar system in FIG. 2*a* as assembled.

FIGS. 1, 2*a*, and 2*b* illustrates each, a part of a bar system 1 comprising a bar 2, a rectangular block 3, and a threaded support rod 4 according to prior art. In FIG. 1 the bar 2 is U-shaped and each side 5 of the block 3 facing a shank 6 of the bar 2 is provided with a hook formed snap fastener 7. The snap fasteners 7 and the block 3 are formed in one piece and one end of each snap fastener 7 is attached to the block 3 by a resilient joint 9. The resilient joint 9 consists of two protruding rectangular holders, one on each side of the end of the snap fastener 7. The block 3 is provided with a vertical through hole 8 extending from a vertically lower side of the block 3 to a vertically upper side. The through hole 8 is internally threaded and adapted to receive the support rod 4. Each shank of the bar 2 comprises a rectangular through hole 10, which is adapted to receive the snap fastener 7 of the corresponding side of the block 3.

During assemblage of the block 3 in FIG. 1 to the bar 2, the block 3 is pushed into the U-shaped bar 2 such that the snap fasteners 7 of either side thereof are bent away from the block 3 so that the shank 6 of the bar 2 may be positioned between the block 3 and the snap fasteners 7. When the snap fasteners 7 are positioned at corresponding through holes 10 of the shanks 6, the snap fasteners 7 move back resiliently and snap into engagement with the corresponding through holes 10 of the shanks 6. Thus, the snap fasteners 7 are located mainly on the outside of the bar 2 and the resilient joints 9 together with the snap fasteners 7 enclose partly the lower parts of the shanks 6 of the bar 2, when the block 3 is assembled to the bar 2. Consequently, for being able to assemble the bar system 1, the block 3 has to have a vertical height which protrudes below of the shanks 6 of the bar 2 at least with the height of the rectangular holders.

In FIGS. 2*a* and 2*b* a somewhat different embodiment of a bar system 1 according to prior art is illustrated. The bar 2 comprises outwardly extending horizontal flanges 12 at the lower end of the shanks 6. The flanges 12 are provided with through holes 13, which are positioned flush with the through holes 10 of the shanks 6 as seen in a longitudinal direction of the bar 2. Moreover, the bar system 1 is essentially similar to the system in FIG. 1. During application of the block 3 in FIG. 2*a* to the bar 2, the block 3 is pushed into the U-shaped bar 2 such that the snap fasteners 7 are bent away from the block 3 and inserted through each through hole 13 so that the shanks 6 of the bar 2 may be positioned between the block 3 and the snap fasteners 7. When the snap fasteners 7 are positioned at corresponding through holes 10, the snap fasteners 7 move back resiliently and snap into engagement with corresponding through holes 10. Thus, the snap fasteners 7 are located on the outside of the bar 2 and the resilient joints 9 are located underneath a part of the bar 2 when the block 3 is assembled to the bar 2, as is illustrated in FIG. 2*b*. The block 3 extends below the shank of the bar 2.

Figure 3:
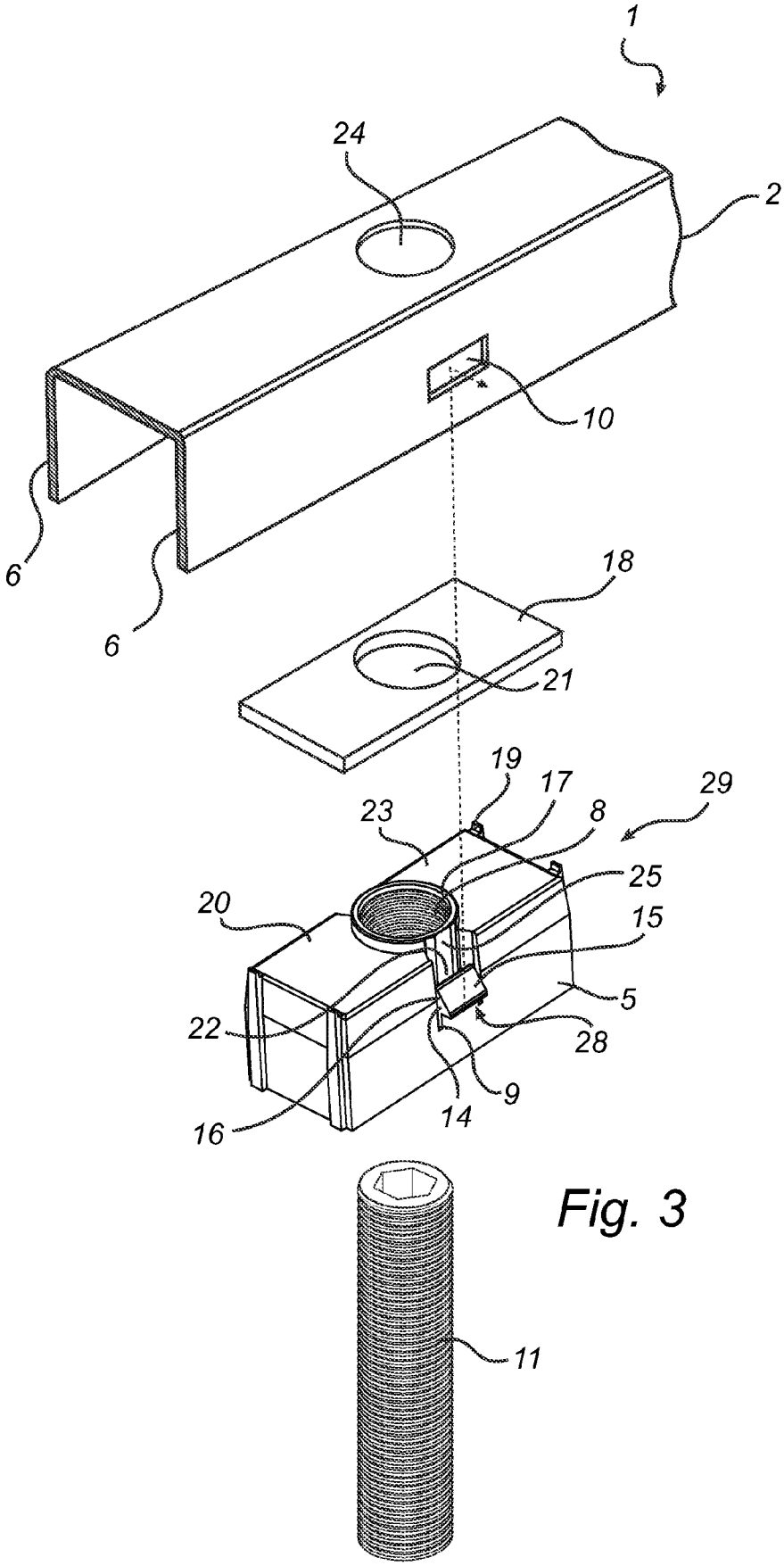
FIG. 3 is an exploded view of a part of an exemplary embodiment of a bar system according to the invention.
Figure 4:
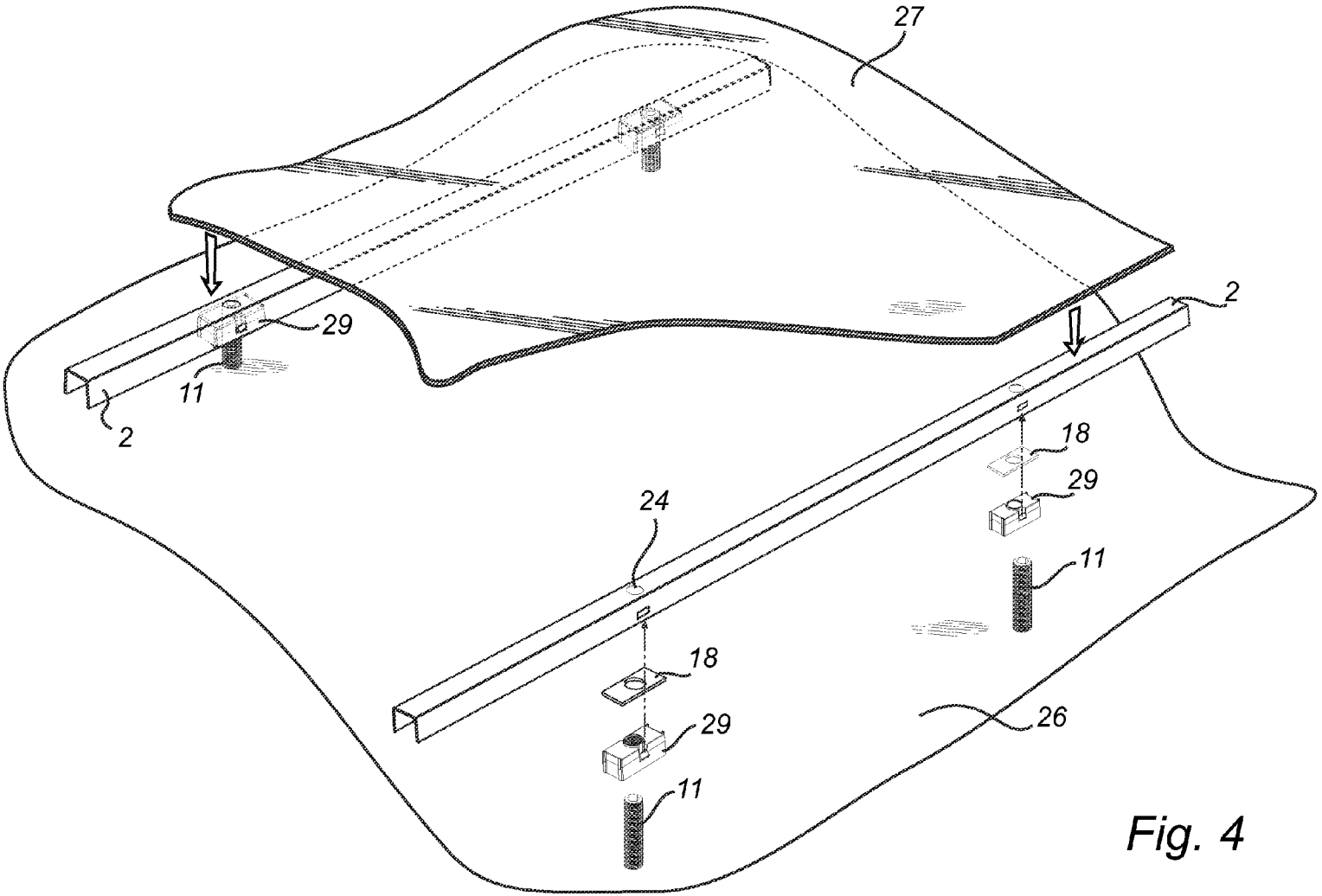
FIG. 4 is a perspective view of the exemplary embodiment of the bar system according to the embodiment in FIG. 3.

Turning now to FIGS. 3 and 4 illustrating a part of one embodiment of the present invention, the bar system 1 comprises bars 2, level adjustment means 29, and dampening means in form of a dampening pad 18.

The bars 2 have a U-shaped cross-sectional configuration and are preferably of metal, such as galvanised, otherwise treated, or untreated steel. Both shanks 6 of each bar 2 are provided with through holes 10 and the through holes 10 are arranged in pairs, oppositely to each other along the longitudinal direction of the bar 2. The part of the bars 2 situated between the shanks 6 are also provided with through holes 24, which are circular and the centre of which are aligned, in a longitudinal direction of the bars 2, with the centre of the through holes 10 of the shanks 6. Even if FIG. 3 shows a part of a bar 2 comprising only one pair of through holes 10, there may be several pairs of through holes 10 along the longitudinal direction of the bar 2. The through holes 10 are arranged at suitable distances between the centres of the through holes as seen in a longitudinal direction of the bars 2, such that desired dampening effect and stability of the bar system 1 is achieved. In general, the dimensions of the bars 2 are such that general specifications within building industry are fulfilled. Such dimensions are preferable for being able to compete with other corporations within the industry, since the building industry is mainly based on such specifications.

Each level adjustment means 29 is generally formed as a rectangular parallelepiped, the longitudinal extension of which may be aligned with the longitudinal direction of the bars 2. The level adjustment means 29 is provided with an internally threaded vertical through hole 8, which extends from a vertically lower side of the level adjustment means 29 to an opposite side. The through hole 8 is centred in the longitudinal direction of the level adjustment means 29, such that a surface 20 on a vertically upper side of the level adjustment means 29 is divided into two contact surfaces 23.

The level adjustment means 29 comprises a level adjustable projection in the shape of a leg 11, which is provided with an outer thread matching the internal thread of the through hole 8 of the level adjustment means 29. Thus, the leg 11 may be screwed into the through hole 8 for screw engagement with its internal threads. The leg 11 is formed as a rod having such a diameter that the strength of the leg 11 is sufficient. The leg 11 also has an internal cavity. The internal cavity preferably has a cross-sectional shape, at least at its upper end that is suitable for tool engagement. For example, the cavity may have a hexagonal cross-sectional shape allowing the level adjustable projection to be rotated for level adjustment by means of an Allen wrench. The other end of the leg 11 is essentially closed and provided with a small through hole, which may receive a suitable fastener (not shown), such as a screw or nail for fixing the bar system 1 to the support structure.

Further, the two longitudinal essentially vertical sides 5 of the level adjustment means 29 are provided with engagement means 28, which are arranged oppositely to each other. Each of the engagement means 28 is formed as an arm 14 having a locking projection 15. The arm 14 is attached to the level adjustment means by a resilient joint 9, which extends along the whole longitudinally extending end of the arm 14 and is formed in one piece in contrast to the joints 9 of the embodiments of the prior art. Such a resilient joint 9 is stronger compared to a joint which does not extend along the whole longitudinally extending end of the arm 14. The locking projection 15 is protruding outwardly, i.e. away from the vertical side 5 of the level adjustment means 29. An upper edge 16 of the locking projection 15 is bevelled. Such a bevelled edge is advantageous since it facilitates application of the level adjustment means 29 to the bar 2. However, within the scope of the invention the edge has not to be bevelled, for instance the edge may be curved or straight. The engagement means 28 are adapted for engagement with the through holes 10 of the bars 2 as is shown by the arrow in the figure.

The upper end of the engagement means 28 is situated vertically lower than the contact surfaces 23. Vertically above the engagement means 28 is a cavity 22. The cavity 22 has basically a trapezoidal cross-section having a shortest side closest to the annular projection 17. The extension of the shortest side of the cavity 22, in the longitudinal direction of the level adjustment means 29, is slightly larger than the extension of the arms 14 of the engagement means 28. The though hole 8 is defined by a separate wall 25 together with the parts of the level adjustment means 29 at the contact surfaces 23.

The vertically upper side of the level adjustment means 29 comprises an annular projection 17 extending along the circumference of the through hole 8. The annular projection 17 is partly an extension of the walls 25 and is provided to be inserted into a through hole 21 of the dampening pad 18, which is described in more detail later. In addition, the annular projection 17 retains the dampening pad 18 in place in a longitudinal and transversal direction of the level adjustment means 29.

The vertically upper side of the level adjustment means 29 comprises also guiding and retaining means 19. The guiding and retaining means 19 are intended to guide the dampening pad 18 to a correct position during application of the dampening pad 18 and to retain the dampening pad 18 in this correct position during assemblage and use of the bar system 1. The intended meaning of "a correct position" is explained later. The guiding and retaining means 19 comprises four projections, two of which are protruding at each short edge at or at the proximity of the corners of the level adjustment means 29. The level adjustment means 29 and the guiding and retaining means 19 are formed in one piece.

The dampening pads 18 are generally rectangular and have a predetermined thickness in their vertical extension. They comprise a vertically extending through hole 21 located at the centre. The through hole 21 has a slightly larger radius than the annular projection 17. The thickness of the dampening pad 18 is larger than the axial extension of the annular projection 17. The transversal extension of the dampening pad 18 is larger than the transversal extension of the level adjustment means 29, and slightly smaller than the width of the bar 2 between the shanks 6. Hence, the dampening pad 18 may fit well between the shanks 6. Since both the through hole 21 of the dampening pad 18 and the through hole 8 of the level adjustment means 29 are centred, the dampening pad 18 protrudes outside the longitudinal edges of the level adjustment means 29. The damping effect of the system depends partly on the area of the dampening pad 18. Since the transversal width of the dampening pad 18 has to fit between the shanks 6 of the bars 2, the longitudinal extension of the dampening pad 18 is large enough for achieving the desired damping effect. Also, the longitudinal extension is such that it compensates for the damping effect lost due to the cavities 22. The longitudinal extension is also such that a dampening pad 18 fits well the level adjustment means 29. That is, the distance between the centre of the through hole 21 and the short edge of the dampening pad 18 equals the distance between the centre of the through hole 8 of the level adjustment means 29 and the guiding and retaining means 19. Thus, the length of the level adjustment means 29 is adapted for receiving a dampening pad 18.

The material of the dampening pads 18 comprises an elastomer which has a very high resistance to short-term extreme overloads and springs back elastically entirely after loading. Further, the material has such an elasticity that there is no risk that estimated long-term dampening needs compress the dampening pads 18 in their vertical direction resulting in that the bars 2 get into contact with the annular projections 17.

The system is assembled by first applying the dampening pad 18 to the level adjustment means 29 such that the annular projection 17 is inserted to the through hole 21 of the dampening pad 18. Thus, the dampening pad 18 rests on and is supported by the contact surfaces 23 of the level adjustment means 29. During this application guiding and retaining means 19 may be used for guiding the dampening pad aligned with the level adjustment means 29. Such guiding and retaining means 19 may also be useful if pre-assembling of the bar system 1 is automated.

Thereafter, the level adjustment means 29 and the dampening pad 18 are pushed in between the shanks 6 of the bar 2 such that the dampening pad 18 is facing the bar 2. During the application of the bars 2, each end of the shanks 6 applies a force to the bevelled edges 16 of the engagement means 28 pressing the arms 14 towards the level adjustment means 29, such that the bar 2 and its shanks 6 may enclose the level adjustment means 29. However, when the engagement means 28 moves towards the level adjustment means 29, the engagement means 28 may only be pushed to the wall 25, not further. Thus, the wall 25 will prevent the engagement means 28 from being pushed such that the resilient joint 9 will break off. Such a risk exists when the engagement means 28 are pushed away from the level adjustment means 29 for engagement with the corresponding through holes 10 on the shanks 6. When the locking projections 15 are facing the through holes 10 of the shank 6, each arm 14 will resiliently move towards the shank 6, such that each locking projection 15 will snap into and lockingly engage with corresponding through hole 10. Thus, the engagement means 28 are located substantially on the same side of the shank 6 as the level adjustment means 29 in an assembled position. Consequently, the level adjustment means 29 may have a height that equals or is even smaller than the vertical length of the shanks 6. Hence, the consumption of material for producing level adjustment means 29 according to the invention may be decreased.

During assemblage of the level adjustment means 29 to the bars 2 the guiding and retaining means 19 retain the dampening pad 18 aligned with the level adjustment means 29. Thus, after application of the level adjustment means 29 to the bars 2, the dampening pad 18 is also in "a correct position". The dampening pad 18, which is aligned with the level adjustment means 29, fits well between the shanks 6 of the bar 2 and extends outside the longitudinal edges of the level adjustment means 29 and above the annular projection 17. Since the guiding and retaining means 19 maintains the relative positions of the dampening pad 18 and level adjustment means 29, the level adjustment means will not be in contact with the bar 2. Thus, the dampening pad 18 is in the intended "correct position" and consequently, desired sound damping qualities are achieved after mounting the bar system 1 at the desired place.

The bar system is normally transported partially pre-assembled to a building site, that is, at each pair of through holes 10 along the longitudinal direction of the bars 2 level adjustment means 29 are applied, but the level adjustable projections 5 are not applied to the level adjustment means 29. Thus, the bars 2 and the level adjustment means 29 may be packed more space-efficiently. Since the level adjustment means 29 according to the invention are at least partly enclosed by the bars 2, they may be packed still more space-efficiently. In addition, the engagement means 29 are protected against breakage by the shanks 6 of the bars 2.

FIG. 4 illustrates mounting of the bar system 1 on a support structure 26. When the bar system is mounted at a desired place the legs 11 are screwed into the level adjustment means 29 such that the end comprising the through hole is projecting out from the vertically lower side of the level adjustment means 29. By screwing the legs 11 to a certain degree into the level adjustment means 29, the length of the legs 11 may be adjusted. That is useful since it makes it possible to adjust the height between the support structure 26 and the bars 2. In addition, it makes it easier to adjust the level of the bars 2 such that they are horizontal or in a desired inclination. Such a need may occur for instance when the support structure 26 is rough or uneven.

The bars 2 and the attached level adjustment means 29 are placed on the support structure 26 with desired spacings between the bars 2 such that the bars 2 are supported by the legs 11. Depending on the size of the area that is to be covered with an external surface material of a floor or wall 27, the bars 2 may be cut to desired lengths or two or more bars 2 may be placed such that their ends are located edge to edge.

Thereafter, the legs 11 may be adjusted vertically from the upper side of the bars 2 through the through hole 24, using an Allen wrench or the like. In that way the legs 11 may be precisely adjusted such that the bars 2 are horizontal or in a desired inclination regardless of potential roughness of the support structure 26. When the legs 11 are adjusted such that the bars 2 are orientated as desired, the parts of the legs 11 projecting out from the upper side of the bars 2 are cut off. The level adjustment means 29 are attached to the support structure using the fastener (not shown) which is inserted through the leg 11 and attached to the support structure 26 through the through hole in the lower end of the leg 11. Due to this fastening procedure it is not convenient to make the legs 11 less in diameter since it would make fastening more difficult. Consequently, the through hole 8 of the level adjustment means 29 may not be smaller in diameter. On top of the bars 2 the external surface material of the floor or wall 27 is subsequently applied.

Figure 5:
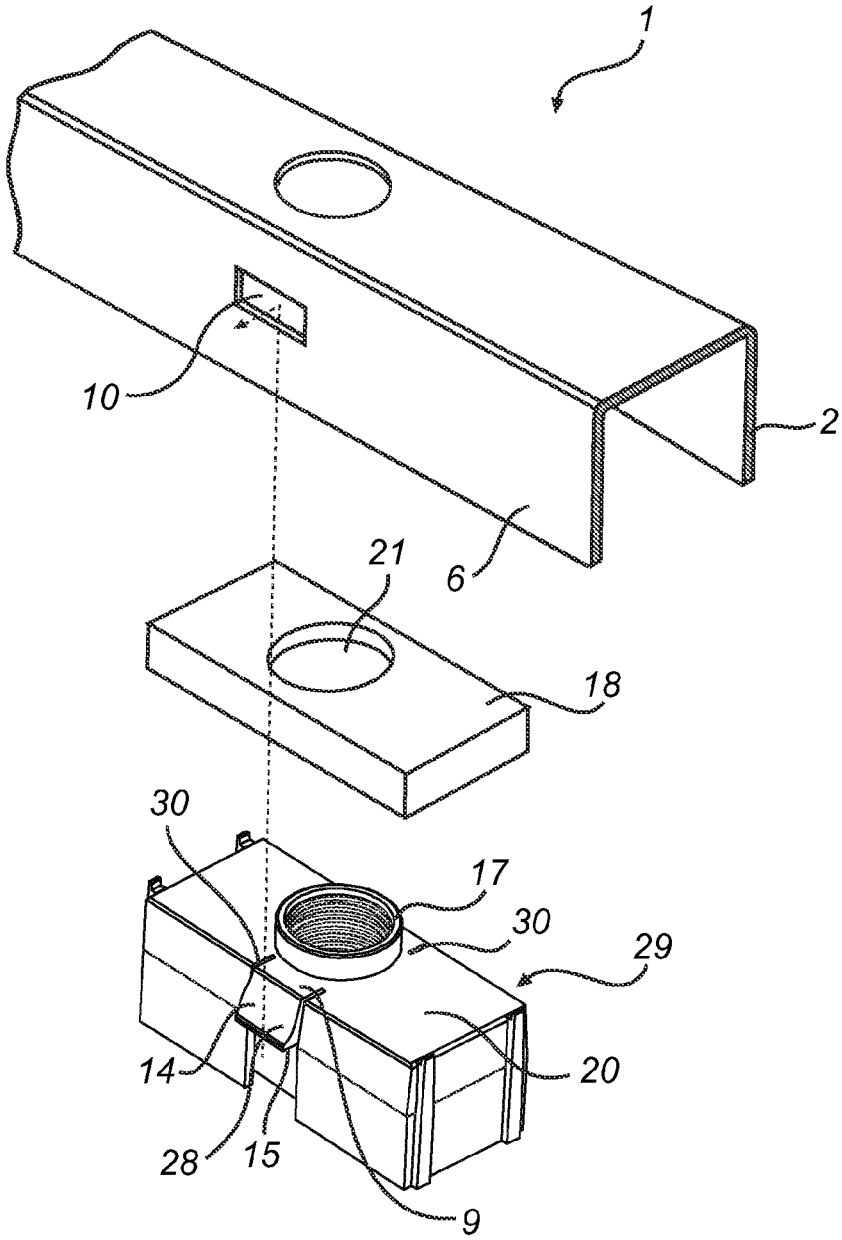
FIG. 5 is a perspective view of a part of a bar system according to an alternative embodiment of the invention.
Figure 5:
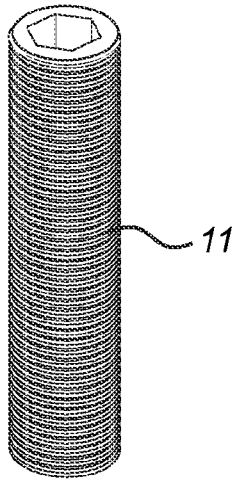

FIG. 5 illustrates another exemplary embodiment of a bar system 1 according to the invention. The bar system is provided with a dampening pad 18 having different thickness than the bar system 1 in FIG. 3. It may be desirable, for instance for manufacturing reasons, to be able to use bars 2 comprising through holes 10, at same distances from the upper side of the bars 2 for the embodiments in FIGS. 3 and 5. Thus, the height of the level adjustment means 29 of the embodiment in FIG. 5 differs compared to the height of the level adjustment means 29 of the embodiment in FIG. 3. For example, the dampening pad 18 of the embodiment in FIG. 5 is thicker than the dampening pad 18 of the embodiment in FIG. 3. Thus, the part of the level adjustment means 29 above the engagement means 28 have a smaller vertical extension than the corresponding part on the level adjustment means 29. In addition, the height of the annular projection 17 is larger than the height of the annular projection 17 in FIG. 3.

In spite of the different heights of the level adjustment means 29 of the embodiments in FIGS. 3 and 5, the level adjustment means 29 may be moulded using the same moulding tool. Before the material of the level adjustment means 29 is inserted to the moulding tool, different types of inserts are inserted into the moulding cavity depending on both the height of the final level adjustment means 29 and the type of the engagement means 28. For instance, in case of a level adjustment means 29 having a large height the inserts are relatively small. Another way to achieve the same result, i.e. using the same moulding tool for different level adjustment means 29, could be to also use the same inserts but mount them on the moulding tool differently according to the desired position of the resulting engagement means.

The damping effect of the bar system 1 depends among other things on the thickness of the dampening pad 18 and, as is pointed out earlier, the area thereof. The material of the dampening pad 18 is expensive, thus it is desired to use as little material as possible. Also, the material of the dampening pad 18 is much more expensive than the material of the level adjustment means 29. Consequently, a thinner dampening pad 18 will result in a remarkably lower total cost of the bar system 2, even if the consumption of material for producing a level adjustment means 29 to such a thinner dampening pad 18 may be higher, if the height of the level adjustment means 29 is larger. Further, different types of building sites require different damping effects, and consequently in some applications it may be possible to save expenses by choosing a thinner dampening pad 18. Also, a specific customer may think that a lower damping effect is sufficient for saving costs. For being able to use similar bars 2 to bar systems with different heights of dampening pads 18, the height of the level adjustment means 29 has to be varied, as is explained earlier. However, the blocks 3 of embodiments of prior art were practically impossible to produce with varying heights using the same moulding tool, thus such a block does not enable varying the thickness of the dampening pads 18.

Another difference between the embodiments in FIGS. 3 and 5 is that the embodiment in FIG. 5 has another type of engagement means 28. The locking projections 15 are arranged on arms 14, which are attached to the level adjustment means 29, such that a vertically lower end is movable. The other end is attached to the level adjustment means 29, by a resilient joint 9, which extends along the whole longitudinally extending end of the arm 14, and is formed in one piece. An upper edge of the locking projection 15 is bevelled. Such a thicker dampening pad 18 does not request a level adjustment means 29 having an engagement means 28 with a movable lower end, a level adjustment means 29 having an engagement means 28 with a movable upper end, according to the embodiment in FIG. 3, may also be used. In other words, the type of engagement means 28 which may be used is not limited to the thickness of dampening pad 28 or vice versa.

The surface 20 is formed by one part and is thus not divided in two parts. Although the surface 20 in FIG. 5 comprises a slit 30 on both sides of the resilient joint 9, the invention is not limited to such an engagement means 28. Instead, if the free end of the arm 14 is movable enough without the slits 30, such that the level adjustment means 29 may be enclosed by the shanks 6 of the bar 2, such an embodiment is within the scope of the invention. Moreover, the bar system 1 is essentially similar to the embodiment in FIGS. 3 and 4.

Figure 6:
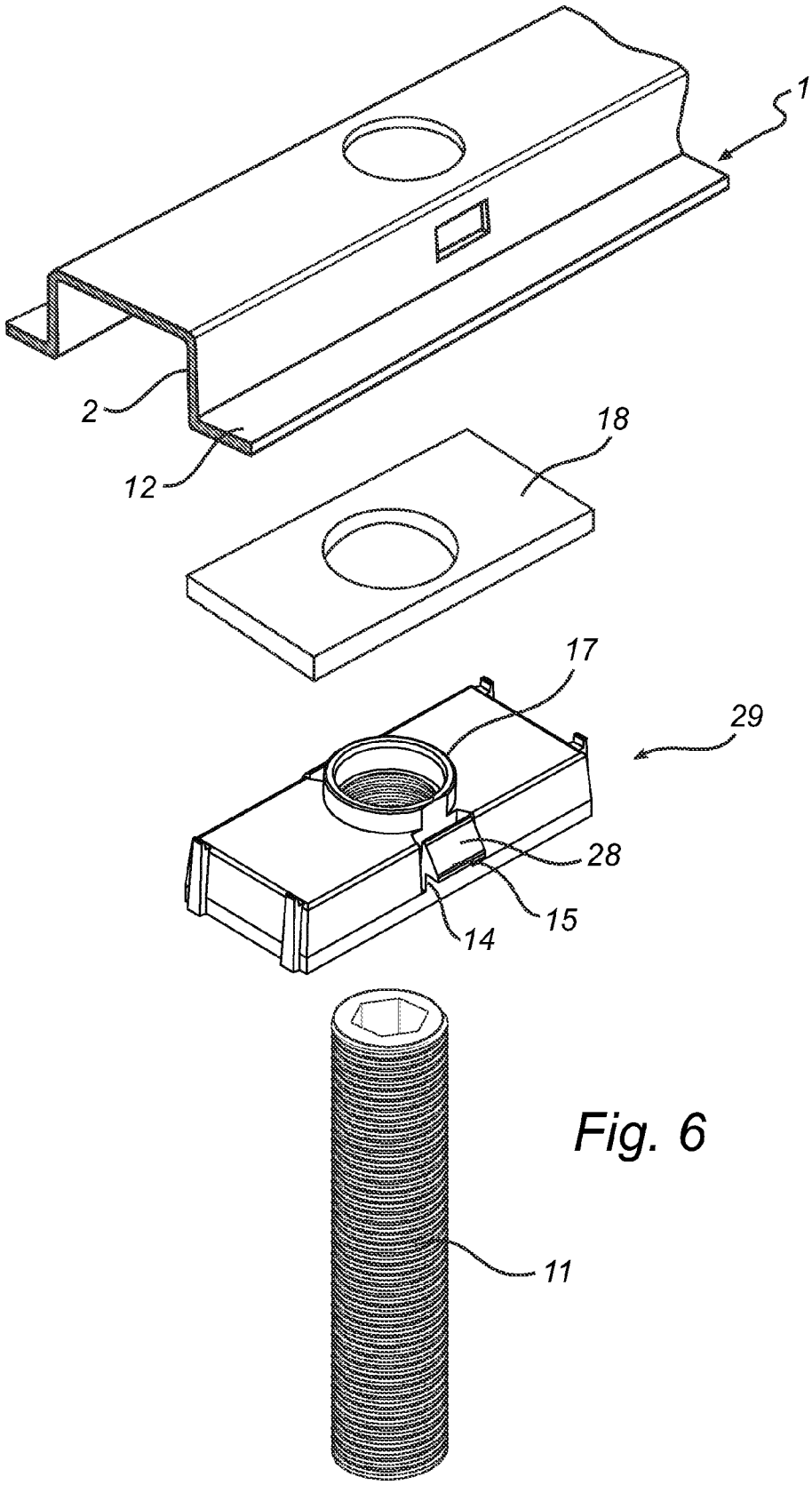
FIG. 6 is a perspective view of a part of a bar system according to an alternative embodiment of the invention.

FIG. 6 illustrates another exemplary embodiment of the bar system according to the invention. The bar 2 in FIG. 6 has outwardly extending horizontal flanges 12 located at the lower ends of the shanks 6. The level adjustment means 29 are provided with an engagement means 28 according to the invention, i.e. having an arm 14 with a locking projection 15 which is pressed towards the level adjustment means 29. Hence, for being able to assemble the level adjustment means 29 to the bars 2, the flanges 12 need not to be provided with through holes. This way the bars may be easier and hence cheaper produced. The bars of this embodiment may also be produced from sheet metal having the same width as for example the bars of the embodiment in FIG. 5. Since the dimensions of the bars 2 are such that general specifications, or standards, within building industry are fulfilled, the width between the shanks 6 of the bars 2 are the same independent of the embodiments of the invention. In the prior art embodiment shown in FIGS. 2*a*-2*b* it is generally not possible to produce the bars 2 of the embodiments in FIGS. 1 and 2*a*-*b* from sheet metal having the same width, since there must be enough material on the outer edges of the through holes 13 due to strength requirements. Consequently, the total length of the shanks of the FIG. 6 embodiment may be shorter than in the prior art of FIGS. 2*a* and 2*b*. If instead using the present invention and producing both bar types (FIGS. 3 and 5) of the same sheet metal, a more cost-efficient handling and total production is achieved. Such a bar 2 may also be assembled with a level adjustment means 29 comprising an annular projection. The components of the bar system 1 of this embodiment are in addition to this basically similar to the components of the embodiment in FIGS. 3 and 4.

It should also be noted that if using the embodiment according to FIG. 6 and placing a panel on top of the horizontal flanges 12, the panel may come in contact with an engagement means if placed according to prior art (FIGS. 2*a* and 2*b*), but not if using the FIG. 6 embodiment or similar according to the present invention. Thus there will be no vibrations or sound transmissions through the panel and engagement means in the present invention. Also, if placing insulation material on the same flanges 12, the engagement means of the prior art would create an uninsulated volume along the bars which reduces the insulating capacity of the system. This is alleviated if using the present invention.

FIG. 7 illustrates an alternative embodiment of the invention comprising somewhat modified level adjustment means 29 and dampening pad 18. The level adjustment means 29 generally has the shape of an elliptic cylinder, the major axis of which is, in application with a bar 2, in the longitudinal direction of the bar 2. The engagement means 28 are essentially planar and similar to those in the embodiment in FIG. 3. Alternatively, the engagement means 28 may be similar to those in the embodiment in FIG. 5, or have some other suitable configuration within the scope of the invention. The vertically upper side of the level adjustment means 29 comprises guiding and retaining means 19, each centre of which is located at the point on the circumference of the two-part elliptical surface 20 which is farthest away from the centre of the elliptical surface 20. The guiding and retaining means 19 are oblong and arranged as a border along a part of the circumference of the elliptical surface 20. The extension of the guiding and retaining means 19 is such that the dampening pad 18 is retained in correct position during assembling and use of the bar system 1. Alternatively, the guiding and retaining means 19 may comprise two projections analogously to the embodiments in FIGS. 3 and 5. The bar system 1 of this embodiment is moreover essentially similar to the embodiment in FIGS. 3 and 4.

FIGS. 8-11 are cross-sectional views of different embodiments of the bar system according to the invention. All the embodiments in FIGS. 8-11 comprise engagement means 28 having locking projections on arms 14 which are attached to the level adjustment means 29 such that a vertically upper end is movable. The other end is attached to the level adjustment means 29 by a resilient joint 9, which extends along the whole end of the arm 14 and is formed in one piece.

Figure 8:
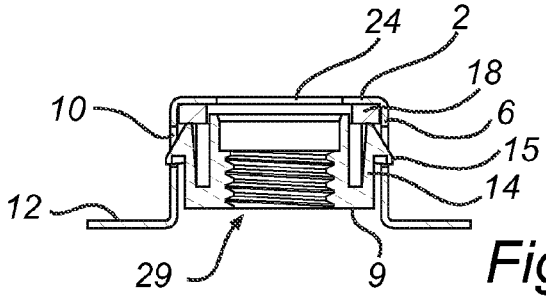
FIG. 8-13 is a sequence of figures illustrating vertical cross-sections of alternative embodiments of bars, level adjustment means and damping means according to the invention.
Figure 9:
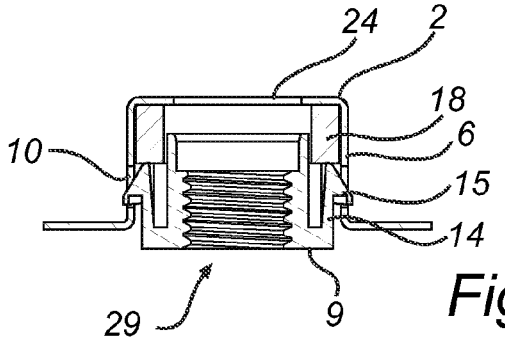

FIGS. 8 and 9 are cross-sectional views of bar systems 1 comprising bars 2 provided with flanges 12. The bar systems 1 are provided with dampening 18 and level adjustment 29 means having different thicknesses. The bars 2 in FIGS. 8 and 9 have through holes 10 which are located at different heights on the shanks 6. However, for being able to use similar bars 2, in which the through holes 10 are located equally, the height of the level adjustment means 29 of the embodiment in FIG. 8 may be different than the height of the level adjustment means 29 of the embodiment in FIG. 9. For example, the dampening pad 18 of the embodiment in FIG. 8 is thinner than the dampening pad 18 of the embodiment in FIG. 9. Thus, for the embodiment in FIG. 8 the part of the level adjustment means 29 above the engagement means 28 may have a larger extension than the corresponding part of the embodiment in FIG. 9. Although, the level adjustment means 29 of FIG. 9 has a height such that it protrudes outside the shanks 6 of the bar 2, within the scope of the invention the height may be lower such that the level adjustment means do not protrude outside the shanks 6 of the bar 2.

Figure 10:
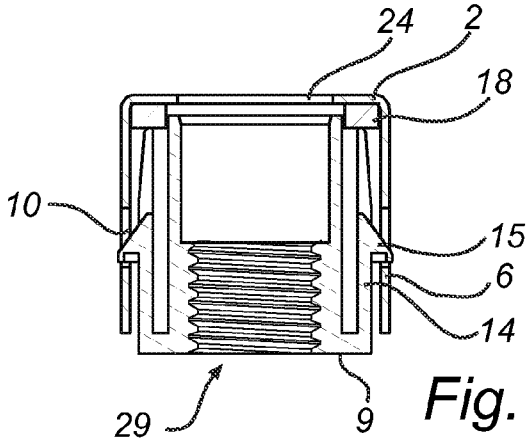
Figure 11:
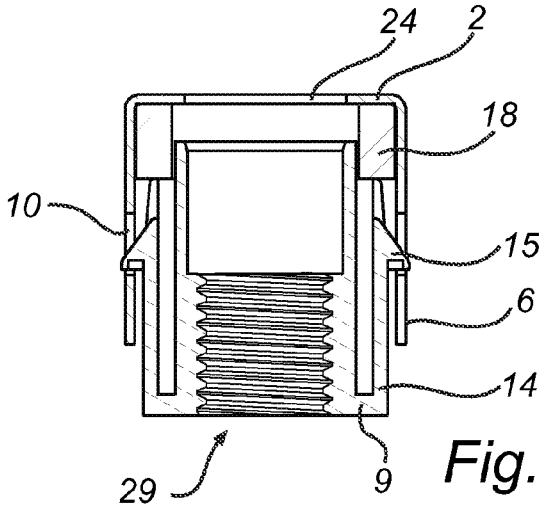

FIGS. 10 and 11 are cross-sectional views of bar systems 1 comprising bars 2 having a U-shaped cross-section. The bar systems 1 are provided with dampening 18 and level adjustment 29 means having different thicknesses. The bars 2 in FIGS. 10 and 11 have through holes 10 which are located at different heights on the shanks 6. However, for being able to use similar bars 2, in which the through holes 10 are located equally, the height of the level adjustment means 29 of the embodiment in FIG. 10 may be different than the height of the level adjustment means 29 of the embodiment in FIG. 11. For example, the dampening pad 18 of the embodiment in FIG. 10 is thinner than the dampening pad 18 of the embodiment in FIG. 11. Thus, for the embodiment in FIG. 10 the part of the level adjustment means 29 above the engagement means 28 may have a larger extension than the corresponding part of the embodiment in FIG. 11. Although, the level adjustment means 29 of FIG. 11 has a height such that it protrudes outside the shanks 6 of the bar 2, within the scope of the invention the height may be lower such that the level adjustment means do not protrude outside the shanks 6 of the bar 2.

The embodiments in FIGS. 8-11 are moreover essentially similar to the embodiment in FIGS. 3 and 4.

Figure 12:
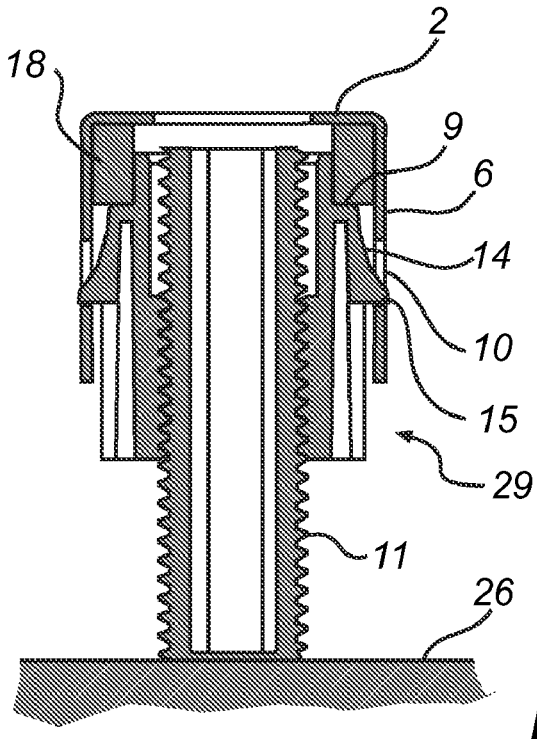
Figure 13:
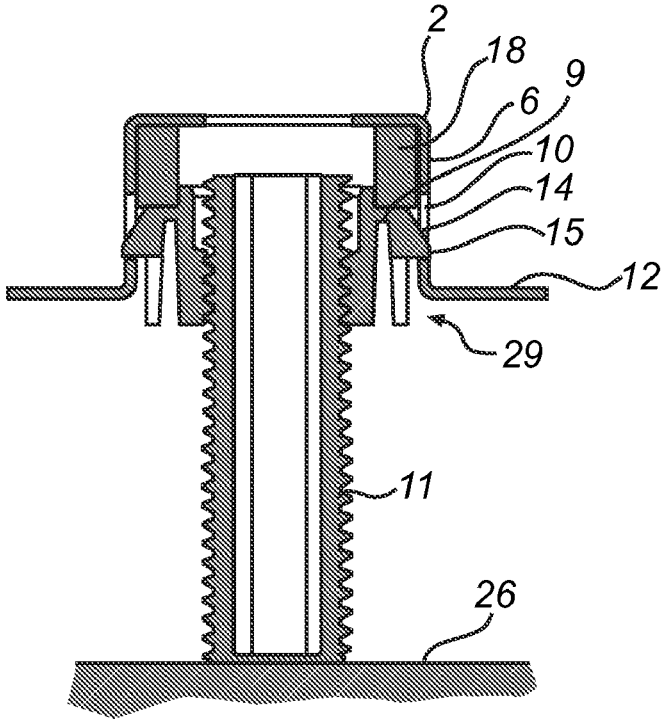

FIGS. 12-13 are cross-sectional views of still another exemplary embodiments of a bar system 1 according to the invention. The embodiments in FIGS. 12-13 comprise engagement means 28, having locking projections on arms 14, which are attached to the level adjustment means 29, such that a vertically lower end is movable. The other end is attached to the level adjustment means 29, by a resilient joint 9, which extends along the whole end of the arm 14 and is formed in one piece. FIGS. 12 and 13 illustrates also the legs 11 supporting the bar system 1 against a support structure 26. In other aspects the embodiments in FIGS. 12 and 13 are similar to the embodiment in FIGS. 3 and 4.

Within the scope of the invention each type of level adjustment means 29 independently of the type of engagement means 28 may be combined with an arbitrarily thick dampening pad 18 provided that the annular projection 17 of the level adjustment means 29 has a lower height than the thickness of the dampening pad 18.

Although the present invention has been described in connection with particular embodiments thereof, it is to be understood that various modifications, alterations and adaptations may be made by those skilled in the art without departing from the scope of the invention, as defined by the following claims. For instance, the shanks 6 of the bars 2 may have recesses, intended for engagement with the engagement means 28, which are not through holes. The shanks 6 do not have to be perpendicular to corresponding upper sides of the bars 2. Instead, they may have a suitable inclination. Further, the bars 2 may comprise or be fully made of some other suitable material than metal.

Within the scope of the invention, the level adjustment means 29 may have only one engagement means 28 on one of the generally vertical longitudinal sides 5, several engagement means 28 on one or both of the generally vertical longitudinal sides 5, or the engagement means 28 on opposite sides may be displaced in relation to each other. The level adjustment means 29 may have engagement means 28 that are attached to the level adjustment means 29 in both an upper and lower end thereof and flexible at the middle. Alternatively, the engagement means 28 may have an extension along the whole generally vertical longitudinal sides 5 of the level adjustment means. In such case the corresponding through holes 10 of the bars 2 has a matching extension as seen in a longitudinal direction of the bars 2.

Although the level adjustment means of all embodiments in the figures are provided with annular projections 17, within the scope of the invention they do not have to be provided with such a projection.

The guiding and retaining means 19 may comprise only one projection at each short edge, only two projections at one of the short edges, or only one sufficiently wide projection at one of the short edges. Alternatively, one or both of the short edges may have an oblong retainer arranged as a border along the whole short edge. Instead of or in addition to guiding and retaining means 19 located at the circumference of the vertically upper side of the level adjustment means, the contact surfaces may comprise outwardly protruding pins that retains the dampening pad 18 in a correct position. Still alternatively, the dampening pad 18 may be attached to the level adjustment means 29 using an adhesive, and the level adjustment means 29 may be formed without guiding and retaining means 19 of the type described herein.

The level adjustment means 29 and the annular projection 17 as well as the guiding and retaining means 19 may be formed in one piece as is described above, or in two or more pieces as well.

The invention claimed is:

1. A bar system for building constructions, comprising bars, level adjustment means, and dampening means, each of said bars comprising a recess positioned in a shank of said bars, said bars being adapted in use to at least partly enclose the level adjustment means, said level adjustment means comprising level adjustable projections, being adapted to project from the bars against a support structure, said level adjustment means being provided with a surface which extends in a longitudinal direction of the bars, as seen in the use of the system, and with engagement means adapted for engagement with said recess, wherein said engagement means is attached to the level adjustment means by a resilient joint, the level adjustment means comprising a slit on both sides of the resilient joint, wherein the shank, which comprises the recesses that is adapted to engage with the engagement means, is adapted to press said engagement means towards said level adjustment means during application of the bars to the level adjustment means, and said recess is adapted to allow the engagement means for moving resiliently back by means of said resilient joint for engagement with said recess in an interconnected position, and in that the dampening means extends in a longitudinal direction of the bars, as seen in the use of the system, and said surface of the level adjustment means is adapted to support the dampening means.

2. The bar system according to claim 1, in which said engagement means is provided with an arm, which arm is located in relation to the level adjustment means such that an outer surface of said arm is in line with an outer surface of the level adjustment means.

3. The bar system according to claim 1, wherein said recesses are adapted to receive said engagement means.

4. The bar system according to claim 1, wherein said recesses are through recesses.

5. The bar system according to claim 1, wherein said engagement means are adapted for snap fastening attachment to the corresponding recesses.

6. The bar system according to claim 1, wherein said engagement means are provided with locking projections formed on arms, which locking projections are protruding outwards from a side of the level adjustment means that is facing the shank in use of the system.

7. The bar system according to claim 1, wherein said locking projections comprises bevelled edges facing the bars during application of the bars, for facilitating said application.

8. The bar system according to claim 1, wherein the level adjustment means are provided with a through hole, which through hole is internally threaded and which threads are matching external threads provided on the level adjustable projections.

9. The bar system according to claim 1, wherein a side of the shank opposite to the level adjustment means comprises projecting flanges extending in a longitudinal direction of the bars.

10. The bar system according to claim 1, wherein the level adjustable projection may be screwed into or out from the level adjustment means through holes in the bars, from the side of the bars opposite a side facing the support structure.

11. The bar system according to claim 1, wherein said dampening means are adapted to be positioned vertically between said bars and said level adjustment means as seen in the use of the system.

12. The bar system according to claim 1, wherein a side of the level adjustment means which in use is facing away from the support structure comprises an annular projection protruding from said side and having a circumference which matches a through hole of the dampening means.

13. The bar system according to claim 1, wherein an extension of the dampening means transversally to the bars, as seen in the use of the system, is larger than an extension of the level adjustment means in the same direction, and wherein an end of the surface of the level adjustment means comprises guiding and retaining means for guiding and retaining the dampening means in a position that inhibits the bars from being in contact with the level adjustment means during use of said system.

14. The bar system according to claim 13, wherein said guiding and retaining means comprise at least one protrusion, which protrudes substantially perpendicularly from the surface of the level adjustment means and is adapted to abut against a lateral side of the dampening means, which lateral side is in use of the system transversal to the bars.

15. The bar system according to claim 14, wherein said guiding and retaining means comprises two sets of protrusions, each of which comprises at least two separate protrusions, which protrusions and sets of protrusions are oppositely arranged in relation to each other, and which protrusions are arranged to abut on opposite parts of a lateral side of the dampening means.

16. A bar system for building constructions, comprising:

a plurality of elongate bars, each having a recess defined within a portion therein;

level adjustment means adapted to at least partially be enclosed by at least one of the bars in which a surface of the level adjustment means extends in a longitudinal direction parallel with a longitudinal direction of the bars, the level adjustment means including engagement means extending from a resilient joint and adapted for engagement with the bars through the recesses, wherein the engagement means flex inwardly during attachment with the bars, and wherein the engagement means flex outwardly when received by the recesses in the bars to secure the engagement means at least partially within the bars;

level adjustable projections being adapted to project from the bars and through the level adjustment means and against a support structure; and dampening means disposed between an inner surface of the bars and the level adjustment means and extending in the longitudinal direction of the bars, wherein the dampening means is supported by a surface of the level adjustment means.

17. The bar system of claim 16, wherein the level adjustment further includes a slit defined on a side of the level adjustment means and extending from the engagement means.

18. The bar system of claim 16, wherein the elongate bars include flanges extending in the longitudinal direction of the bars.

19. The bar system of claim 16, wherein an annular projection protrudes from a surface of the level adjustment facing the dampening means, wherein the annular projection has a circumference that generally matches a circumference of a through hole in the dampening means.

* * * * *